US012044003B2

(12) United States Patent
Hettwer

(10) Patent No.: US 12,044,003 B2
(45) Date of Patent: Jul. 23, 2024

(54) FLUSH MOUNT BAFFLE FOR FINISHED CEILINGS AND WALLS

(71) Applicant: USG Ceilings Plus, LLC, Commerce, CA (US)

(72) Inventor: Stephen Hettwer, Chino Hills, CA (US)

(73) Assignee: USG CEILINGS PLUS, LLC, Commerce, CA (US)

( * ) Notice: Subject to any disclaimer, the term of this patent is extended or adjusted under 35 U.S.C. 154(b) by 428 days.

(21) Appl. No.: 17/482,583

(22) Filed: Sep. 23, 2021

(65) Prior Publication Data

US 2023/0093579 A1 Mar. 23, 2023

(51) Int. Cl.
*E04B 1/82* (2006.01)

(52) U.S. Cl.
CPC ..... *E04B 1/8209* (2013.01); *E04B 2001/829* (2013.01)

(58) Field of Classification Search
CPC .. E04B 1/8209; E04B 2001/829; E04B 9/005; E04B 9/0457; E04B 9/366; E04B 9/008; E04B 9/18; E04B 9/183; E04B 9/22; E04B 9/225; E04B 9/24; E04B 9/242; E04B 9/28; E04B 9/34
See application file for complete search history.

(56) References Cited

U.S. PATENT DOCUMENTS 3,342,006 A * 9/1967 Gerald ..... E04B 9/005 52/506.07
3,387,872 A * 6/1968 Lovullo ..... E04B 9/005 52/506.07
4,031,664 A * 6/1977 Wendt ..... E05D 15/06 248/300
4,227,355 A * 10/1980 Wendt ..... E04H 1/1238 52/64
4,549,375 A * 10/1985 Nassof ..... E04B 9/005 52/762
4,926,606 A * 5/1990 Hanson ..... E04B 9/065 52/506.07
9,920,525 B1 * 3/2018 Underkofler ..... E04B 9/366
(Continued)

FOREIGN PATENT DOCUMENTS

WO 2021/083863 A1 5/2021

OTHER PUBLICATIONS

International Search Report and Written Opinion of Corresponding Application No. PCT/US2022/076561, filed Sep. 16, 2022. Search Report dated Dec. 5, 2022.

*Primary Examiner* — Jessica L Laux
(74) *Attorney, Agent, or Firm* — Pearne & Gordon LLP

(57) ABSTRACT

A baffle assembly for installation on a finished ceiling or wall membrane comprising an elongated base and an elongated panel mountable on the base, the base having fastening areas spaced along its length for receiving fasteners therethrough and anchored on the membrane, the panel having front and rear edges bounding a width of the panel, the panel having a hollow space at the rear edge extending along substantially the full length of the panel, the hollow space being constructed and arranged to receive the base and the base being constructed and arranged upon reception in the hollow to laterally stabilize the panel, the base and panel having interengaged parts concealed in the hollow that maintain the panel on the base.

6 Claims, 2 Drawing Sheets

(56) References Cited

U.S. PATENT DOCUMENTS

| | | | | |
|---|---|---|---|---|
| 10,174,501 | B1 * | 1/2019 | Underkofler | E04B 9/183 |
| 10,359,163 | B1 | 7/2019 | Hettwer et al. | |
| 2011/0232219 | A1 | 9/2011 | Wilkinson, Jr. et al. | |

* cited by examiner

FIG. 3
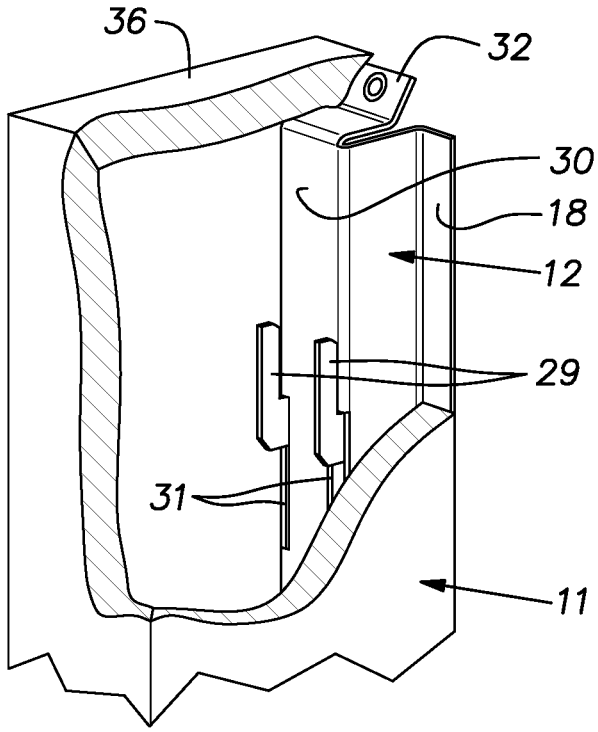
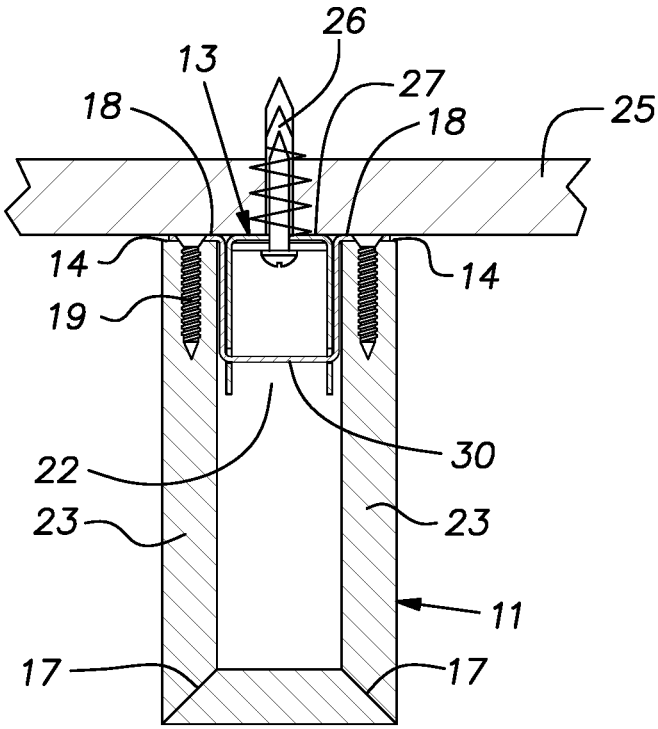
FIG. 4

FLUSH MOUNT BAFFLE FOR FINISHED CEILINGS AND WALLS

BACKGROUND OF THE INVENTION

The invention relates to baffles having aesthetic and sound absorbing qualities.

PRIOR ART

In recent times, acoustical baffles have been hung from suspended ceilings or where no such ceiling exists from overhead building structure. Prior baffle systems for walls and finished ceilings have been complex, relatively expensive to manufacture, and not easily installed. PET felt has been utilized to form baffles due to its sound absorbing character and self-supporting structure. Until now, as far as known, no inexpensively manufactured and easily installed baffle system for finished ceilings and walls has been available.

SUMMARY OF THE INVENTION

The invention provides a system for mounting acoustic baffles on finished ceilings and walls that is relatively simple to manufacture and install. A completed installation provides a flush mounted baffle having an aesthetically clean appearance with no visible fasteners or bracketry.

In the disclosed arrangement the baffle includes a board of needled polyethylene terephthalate (PET) fibers that is grooved and folded into an elongate U-shaped form. Two elongate sheet metal channels form the other principal parts of the inventive baffle assembly. One of the metal channels has a hat-shaped cross-section that all but its "brim" elements are received in the interior of the folded fibrous board. The "brim" elements are each fastened to the board edges at its open or rearward face. The other metal channel has a plain U-shape and is proportional to fit closely into the hat channel. Free edges of the flanges of the U-shaped channel have integral hooks.

During installation of the baffle, the U-shaped channel is first fixed to a ceiling or wall, with its flanges projecting outwardly using suitable mechanical fasteners. The board fitted with the hat channel is assembled over the fixed channel. The hat channel has slots engaged by the hooks of the fixed channel so as to fix the board to the ceiling or wall. The "brim" elements of the hat channel do not extend beyond the width of the folded board so that in a completed installation all parts of the metal channels and any related fasteners are covered by the folded board.

BRIEF DESCRIPTION OF THE DRAWINGS

FIG. 3 is similar to FIG. 2 with baffle parts in assembled relation; and FIG. 4 is a cross-sectional view of the baffle assembly installed on a ceiling or wall.

DESCRIPTION OF THE PREFERRED EMBODIMENT

Figure 1:
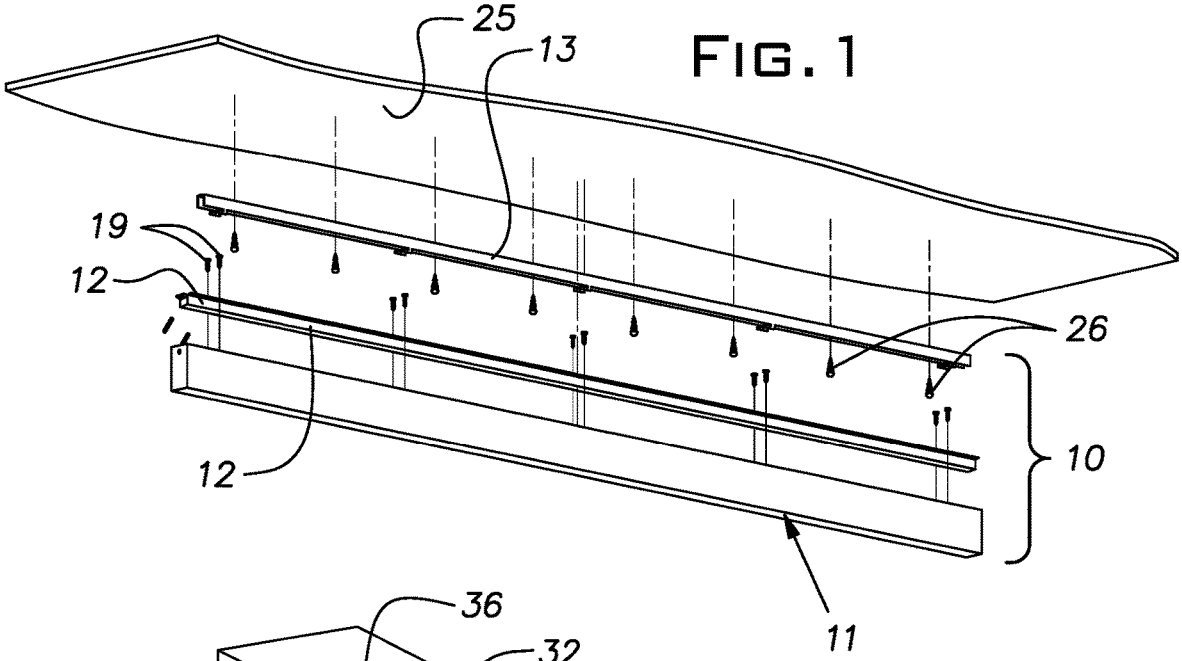
FIG. 1 is an exploded isometric view of the baffle assembly.

A baffle assembly 10 has three principal, elongate parts comprising a board 11, an insert 12 and a base 13 all of essentially the same length. The board 11 is an elongated rigid body, preferably made of porous structure such as commercially available needled PET fiber of a nominal thickness of about one-half inch (12 mm). Ideally, the board 11 is formed of a single continuous sheet or panel that is folded on lines 17 parallel to its edges 14. To enable this folded structure, the board 11 is cut with a 90 degree notch at each fold 17 with a depth leaving a continuous web of a thickness of about 0.020 inch. The insert channel 12 has the cross-section of a hat. "Brim" elements 18 of the channel 12 are fixed with screws or like mechanical fasteners 19 to the board edges 14 and the remainder of the channel fits widthwise and is fixed in a hollow 22 formed between sides 23 of the U-shaped board 11 (FIG. 4).

The base channel 13 is attached to a finished ceiling or wall hereafter sometimes referred to as a membrane 25 with suitable mechanical fasteners 26, with its web, designated 27, abutting the ceiling or wall, extending through associated holes in the web 27 (FIG. 4). The channels 12, 13 are proportioned so that the base channel 13 slides into the insert channel 12 with a small clearance fit of about 0.010 to 0.015 inch. Distal edges of flanges 28 of the base channel 13 are formed with regularly spaced hooks 29, oriented upright when mounted on a wall. A web or "top" element 30 of the insert channel 12 is formed with longitudinally oriented spaced slots 31 located to receive and catch the base channel hooks 29. Longitudinal edges of the hooks 29, proximal to the web 27, are configured so that they are closer to the web as the edge is closer to the base of the hook so that the insert channel 12, and therefor the baffle or board 11 is drawn tightly against the supporting membrane 25. By attaching the hat or insert channel 12 to the edges 14 of the board 11, the channels 12, 13 can be used with a folded board 11 of any depth or projection from a ceiling or wall 25 beyond the projection of the insert 12.

Figure 2:
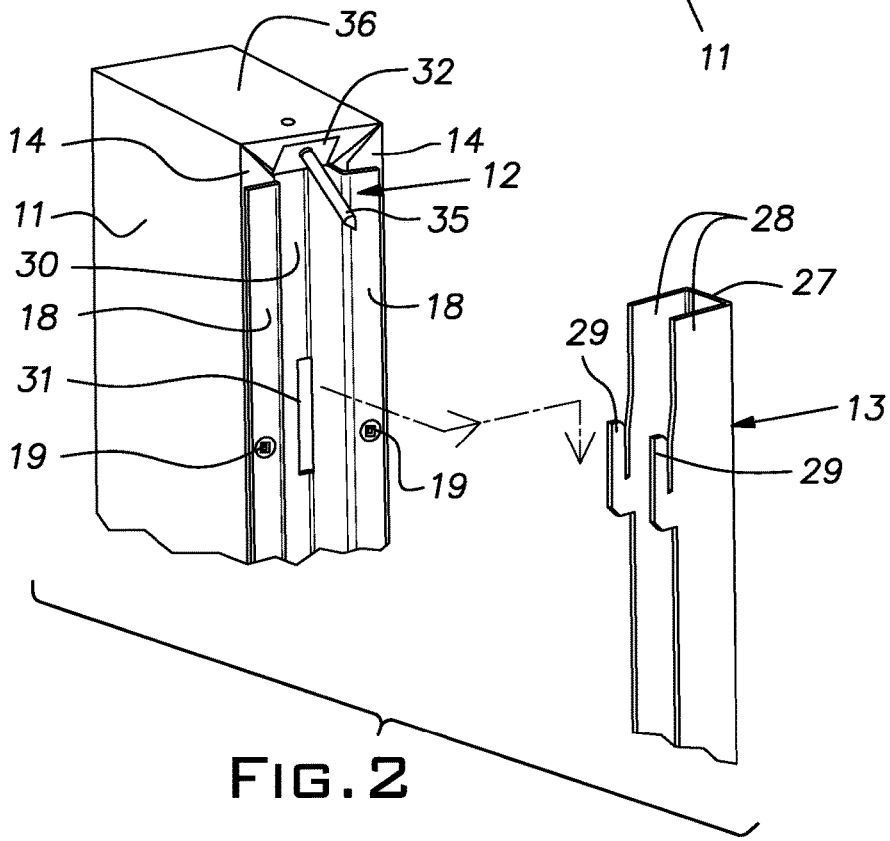
FIG. 2 presents fragmentary isometric views of parts of the baffle assembly.

With reference to FIG. 3, sheet metal extending from the insert "top" portion or web 30, at one end of the insert channel 12 is bent to close the respective channel end and to provide an angled tab 32 that abuts a beveled surface on an end cap 36 of the same porous material as that of the board 11. A screw or other mechanical fastener 35 (FIG. 2) is inserted in an inclined small pilot hole in the cap end cap 36 and an aligned hole in the angled tab 32 and driven into the ceiling or wall membrane to which the assembly 10 is mounted thereby releasable locking the baffle assembly in place. Owing to the fibrous nature of the board material, the small pilot hole in the end cap will return to its original size and conceal the fastener.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A baffle assembly for installation on a finished flat ceiling membrane or flat wall membrane comprising an elongated base and an elongated panel mountable on the base, the base having a length slightly less than the length of the panel and fastening areas spaced along its length for receiving fasteners therethrough to anchor the base on the membrane, the panel having front and rear edges bounding a width of the panel, the panel having a hollow space at the rear edge extending along substantially the full length of the panel, the hollow space being constructed and arranged to receive the base and the base being constructed and arranged upon reception in the hollow to laterally stabilize the panel, an insert having a U-shape with a web and flanges, the inert flanges abutting and being attached to rear end faces of the panel, the base and insert having interengaged parts concealed in the hollow that maintain the panel on the base, the interengaging parts are configured to interengage when the panel is moved longitudinally on the base;

wherein the base is formed of sheet metal and has a U-shaped cross-section with two flanges and an intermediate web, the web providing said fastener receiving areas;

wherein the base flanges provide hooks of said interengaged parts and the insert fixed in said hollow provides slots of said interengaged parts that form hook catches.

2. A baffle assembly as set forth in claim 1, wherein the interengaging parts include hook elements and hook catches.

3. A baffle assembly as set forth in claim 1, wherein the panel is U-shaped in cross-section such that sides and front thereof are of essentially uniform thickness.

4. A baffle assembly as set forth in claim 1, wherein the panel includes sound absorbent fiber.

5. In combination, a baffle and a mounting base for the baffle, the baffle being formed of an elongated porous board with two parallel longitudinal notches generally equally spaced from a longitudinal center of the board and on an inner face of the board, the board having a U-shaped cross-section with parallel sides intersecting said notches, an end face between said sides, and an opening between said sides remote from said end face, an elongated sheet metal insert of hat-shaped cross-section in said opening, parts of the insert corresponding to a hat brim abutting and directly secured to rear edges of the board at said opening, a part of the insert corresponding to a hat top having longitudinally oriented slots of said interengaged parts open to an interior of a space formed between said board sides, the mounting base being formed of sheet metal bent into a U-shaped cross-section with sides and a common web, a distance across the base sides being less than a distance between sides of the insert corresponding to sides of a hat, free edges of the base sides forming hooks of said interengaged parts registerable with the slots of the insert and being capable of securing the baffle to the base upon longitudinal movement of the baffle on the base, the base web being capable of receiving fasteners to attach the base to a wall or ceiling membrane.

6. The combination of claim 5, wherein the hat top channel at one end has an angled tab joined to the web, covered by material the same as the board and adapted to receive a locking screw that can be driven into the ceiling or wall membrane.

* * * * *